US007926121B2

(12) United States Patent
Syphrit

(10) Patent No.: US 7,926,121 B2
(45) Date of Patent: Apr. 19, 2011

(54) SYSTEM FOR SELF-FASTENING ARTICLE

(76) Inventor: Michael J. Syphrit, Pompano Beach, FL (US)

( * ) Notice: Subject to any disclaimer, the term of this patent is extended or adjusted under 35 U.S.C. 154(b) by 851 days.

(21) Appl. No.: 11/899,099

(22) Filed: Sep. 4, 2007

(65) Prior Publication Data

US 2008/0052805 A1 Mar. 6, 2008

Related U.S. Application Data

(60) Provisional application No. 60/842,409, filed on Sep. 5, 2006.

(51) Int. Cl.
*A42B 1/22* (2006.01)

(52) U.S. Cl. ..... 2/183; 2/418

(58) Field of Classification Search ..... 2/417, 418, 2/76, 183

See application file for complete search history.

(56) References Cited

U.S. PATENT DOCUMENTS

| | | | | |
|---|---|---|---|---|
| 1,894,213 | A * | 1/1933 | Ostolaza | 2/182.1 |
| 3,898,699 | A * | 8/1975 | Zientara et al. | 2/175.1 |
| 4,011,600 | A | 3/1977 | Malk | |
| 4,683,596 | A * | 8/1987 | Cole | 2/174 |
| 5,802,617 | A | 9/1998 | Boden | |
| 6,345,395 | B1 * | 2/2002 | Chilton | 2/183 |
| 6,748,606 | B1 | 6/2004 | Silverstein | |

* cited by examiner

*Primary Examiner* — Shaun R. Hurley
*Assistant Examiner* — Andrew W Sutton
(74) *Attorney, Agent, or Firm* — Santucci, Priore, PL; Phillip Vales

(57) ABSTRACT

A system for providing a drawstring for an article of clothing or accessory having a front and a back and having a peripheral surface necessary to be tightened, the system including a semi-rigid crochet layer having a braided strands of a fibrous material defining a pattern in the article having openings which repeat at a number in a range of about 3 to about 8 per linear inch in all directions, and in which the openings of the layer define a range of between about 15 to about 35 percent of the entire surface of the crochet layer and a cord braided of filaments of a material more pliable than the braided strands of the crochet layer.

5 Claims, 8 Drawing Sheets

SYSTEM FOR SELF-FASTENING ARTICLE

REFERENCE TO RELATED APPLICATION

This application claims the benefit under 35 USC 119(e) of the provisional patent application Ser. No. 60/842,409, filed on Sep. 5, 2006, which is hereby incorporated by reference in its entirety.

FIELD OF INVENTION

The present invention relates to a system for a self-fastening article using a cord.

BACKGROUND OF THE INVENTION

Hats whose sizes are adjustable are well known as are adjustable straps for hats. U.S. Pat. No. 4,011,600 to Malk discloses a hat having an adjustable sweatband in order to control the tightness and fit of the hat. U.S. Pat. No. 6,748,606 to Silverstein discloses a hat having an adjustable inner circumference, which also includes a sweatband an adjustable secondary sweatband.

U.S. Pat. No. 5,802,617 to Boden discloses a hat or other headgear having a cord, preferably an elongated flexible plastic tube, with a portion extending across the interior of the hat between opposite sides of a lower portion of the crown, at a location to contact the user's forehead and position the hat relative thereto.

It would be desirable to provide a self-fastening article which is ventilate, simple to adjust, and free from any type of sweatband or inner adjustment which comes into contact with the human head. The present invention addresses this long felt need in the art.

SUMMARY OF THE INVENTION

A system for providing a drawstring for an article of clothing or accessory having a front and a back and having a peripheral surface necessary to be tightened. The system comprises a semi-rigid crochet layer having a plurality of braided strands of a fibrous material and defining a pattern in said article having a multiplicity of openings which repeat at a number in a range of about 3 to about 8 per linear inch in all directions, and in which said openings of said layer define a range of between about 15 to about 35 percent of the entire surface of said crochet layer. The system also includes a cord braided of a plurality of filaments of a material more pliable than said braided strands of said crochet layer, said cord having a beginning, a middle and an end, said cord proportioned for press-fittable insertion between two front openings in said crochet pattern at said front of said article, the openings about one inch apart, in which only about one inch of said cord is positioned inwardly of said crochet layer, relative to a user, with a remaining length of said cord positioned outwardly of said layer extending until said back of said article, at which each end of said braided cord is press-fittable inserted into and out of back openings of said crocheted layer, about one inch apart from each other, said front and back openings occupy a plane in said peripheral surface desired to be tightened in which, at said openings at said back of said article, the beginning and end of said cord are both press-fittably insertable, from opposite directions on said inward side of both openings, leaving portions of said braided cord at said back openings in frictional contact with each other and also with each opening of the back openings in which segments of the beginning and end of the cord each extend beyond said back openings on said outward side of said crochet layer, permitting manual engagement of said segments for purposes of tightening said article of clothing along said plane of said peripheral surface.

It is an object of the invention to provide an efficient self-fastening drawstring system for an article of clothing or accessory.

It is another object is to provide a system which securely fastens an article of clothing or accessory such as a hat without need for any fastening means other than a drawstring.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

The term macramé, as used herein, is a noun meaning a course lace or fringe made by knotting threads or cords in a geometrical pattern and, at times, also refers to the art of tying knots in patterns.

The term crochet, as used herein, is a noun relating to needle work consisting of the interlocking of looped stitches formed with a single thread and a hooked needle.

Figure 4:
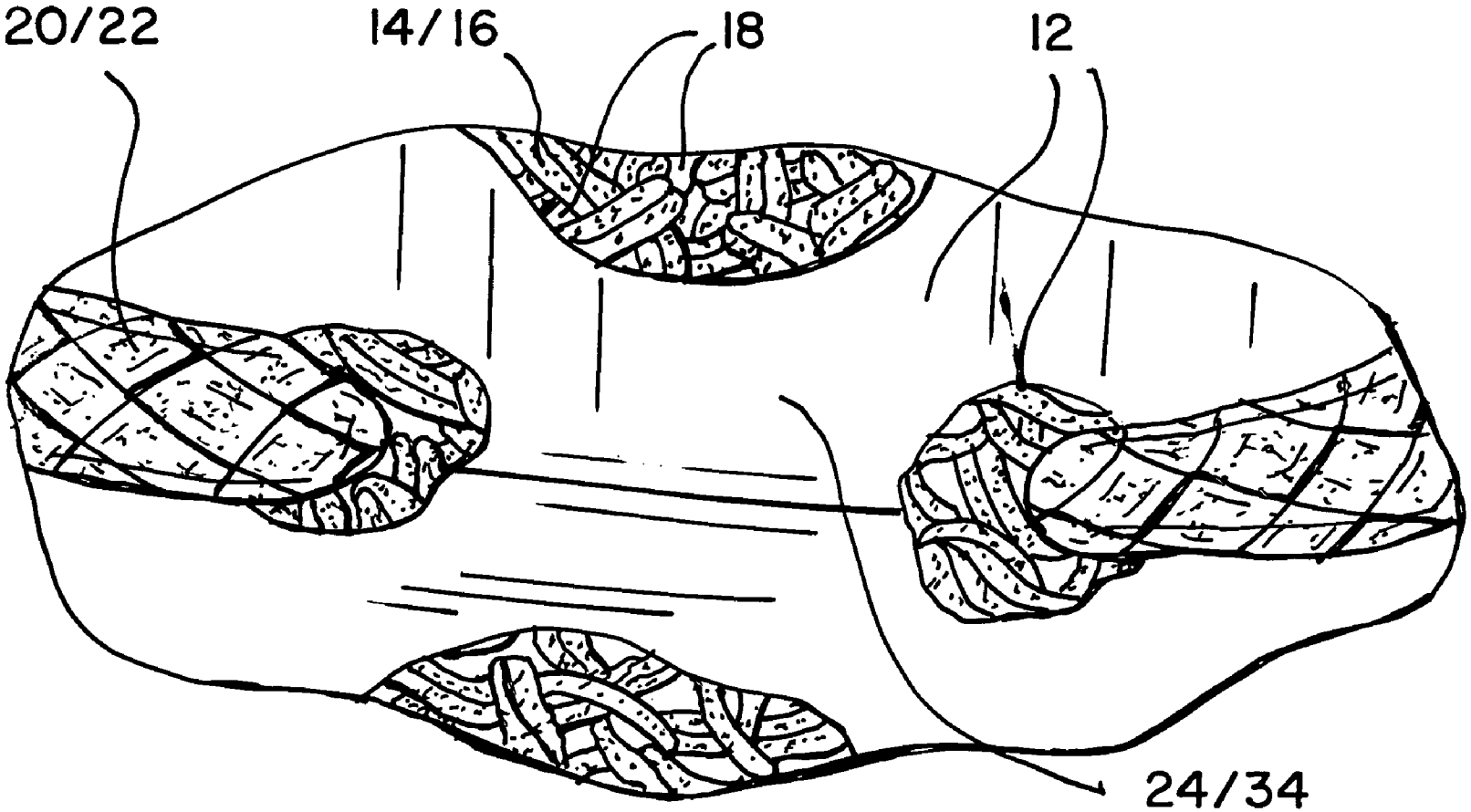
FIG. 4 is a front view of the front holes of the article.
Figure 4A:
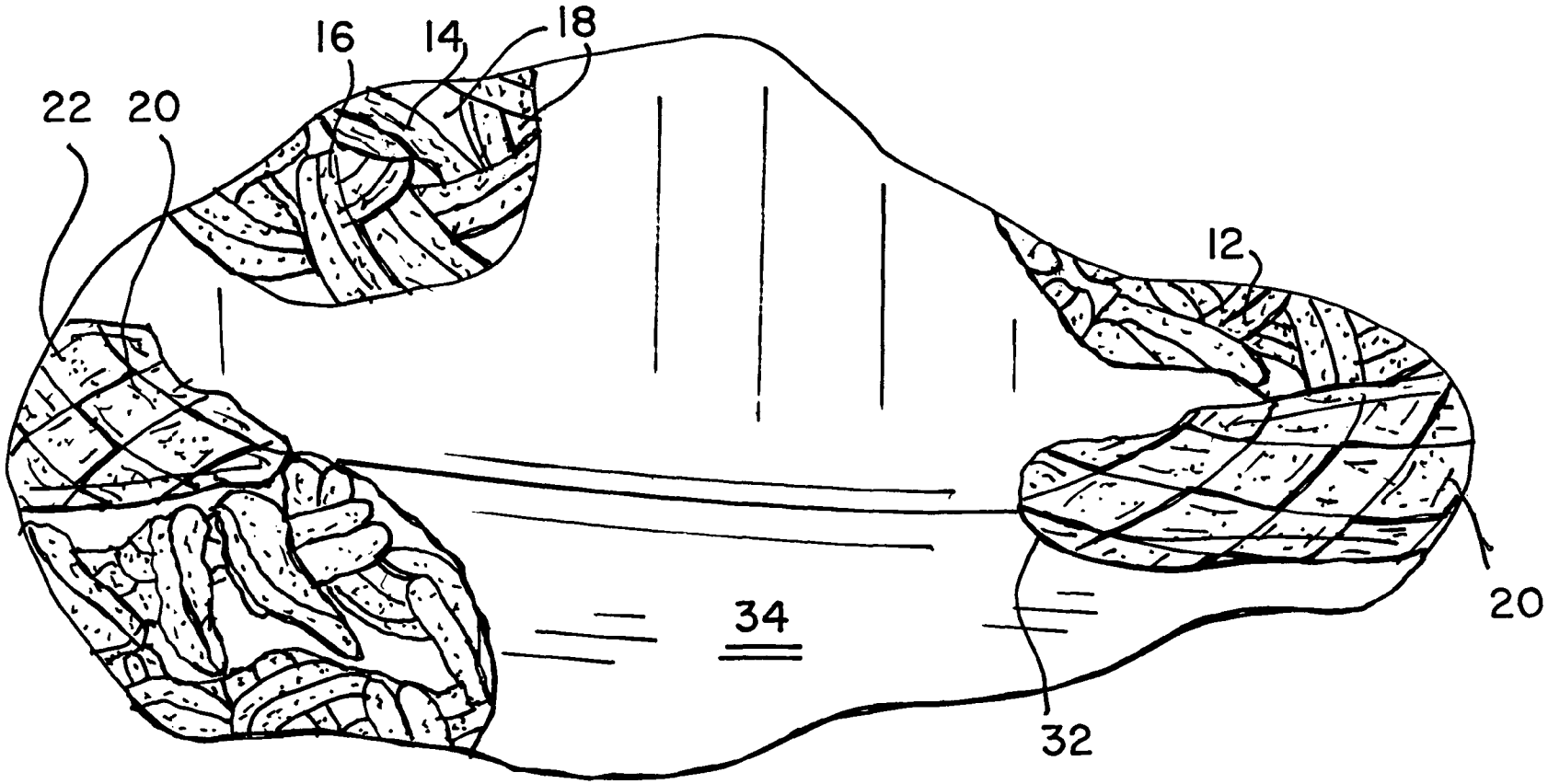
FIG. 4A is an enlarged view of FIG. 4.
Figure 8:
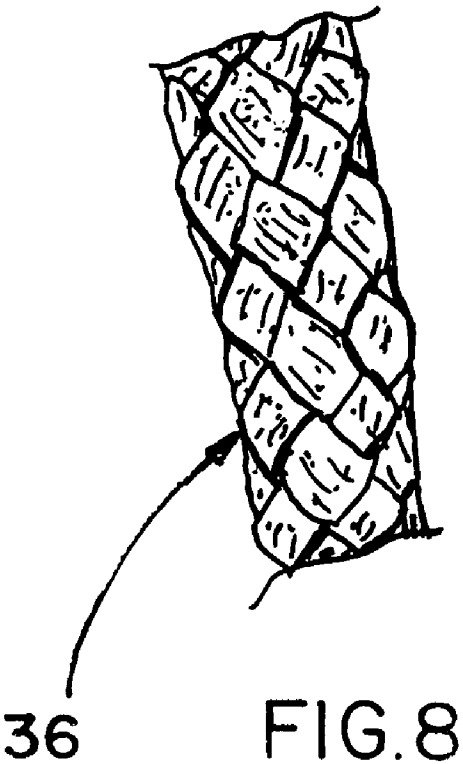
FIG. 8 is an exploded view of the cord.
Figure 7:
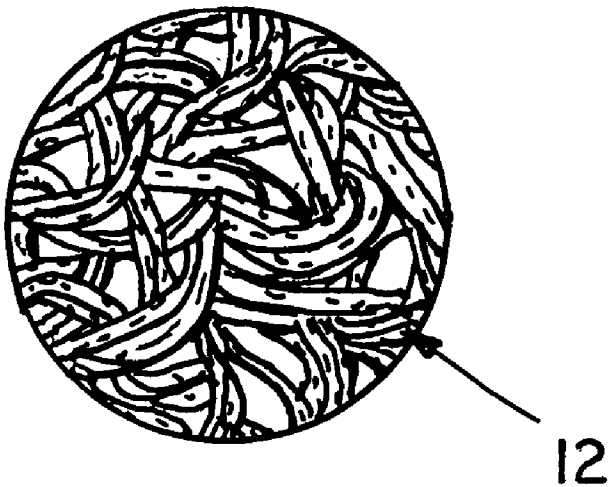
FIG. 7 is an exploded view of the openings.

Certain articles of clothing, such as a hat made of a flexible material, include a lateral peripheral surface, a transverse plane of which must be tightened in order to secure the article of clothing to a part of a the human body. More particularly, such an article of clothing may include a hat 10 (see FIGS. 1 and 2) typically made of a semi-rigid crochet layer 12 which comprises a plurality of fibrous filaments 14 (see FIGS. 4 and 4A) which are braided into individual strands 16. Said strands are crocheted to define a pattern which may be a pattern having many openings 18 of the type shown in the top perspective views of FIGS. 1, 2, 3, 6 and 7. In order words, said semi-rigid crochet layer 12 defines a multiplicity of openings 18 which repeat at a number in a range of about three to about eight per linear inch with a preferred range being that of about three to about five per linear inch, this extending in all directions from a given opening 18. The weaving of said crochet layer 12 is typically such that said openings 18 defines a range of about 15 to about 35 percent of the entire surface of the crochet layer 12. While the use of straw represents the preferred embodiment for said crochet layer, other materials, e.g., polymers having similar properties of flexibility and surface friction may also be employed. Tightening of the crochet layer in a peripheral surface intended to enclose a part of the human body is accomplished through the use of a cord 20, indicated in black in all figures, which itself is preferably formed of a plurality of filaments 22. Said cord 20 may be formed of said filaments 22, preferably by braiding (see FIG. 8). Further, the material of said filaments must be of a material more pliable than that of said braided filaments 14 of the crochet layer.

Figure 1:
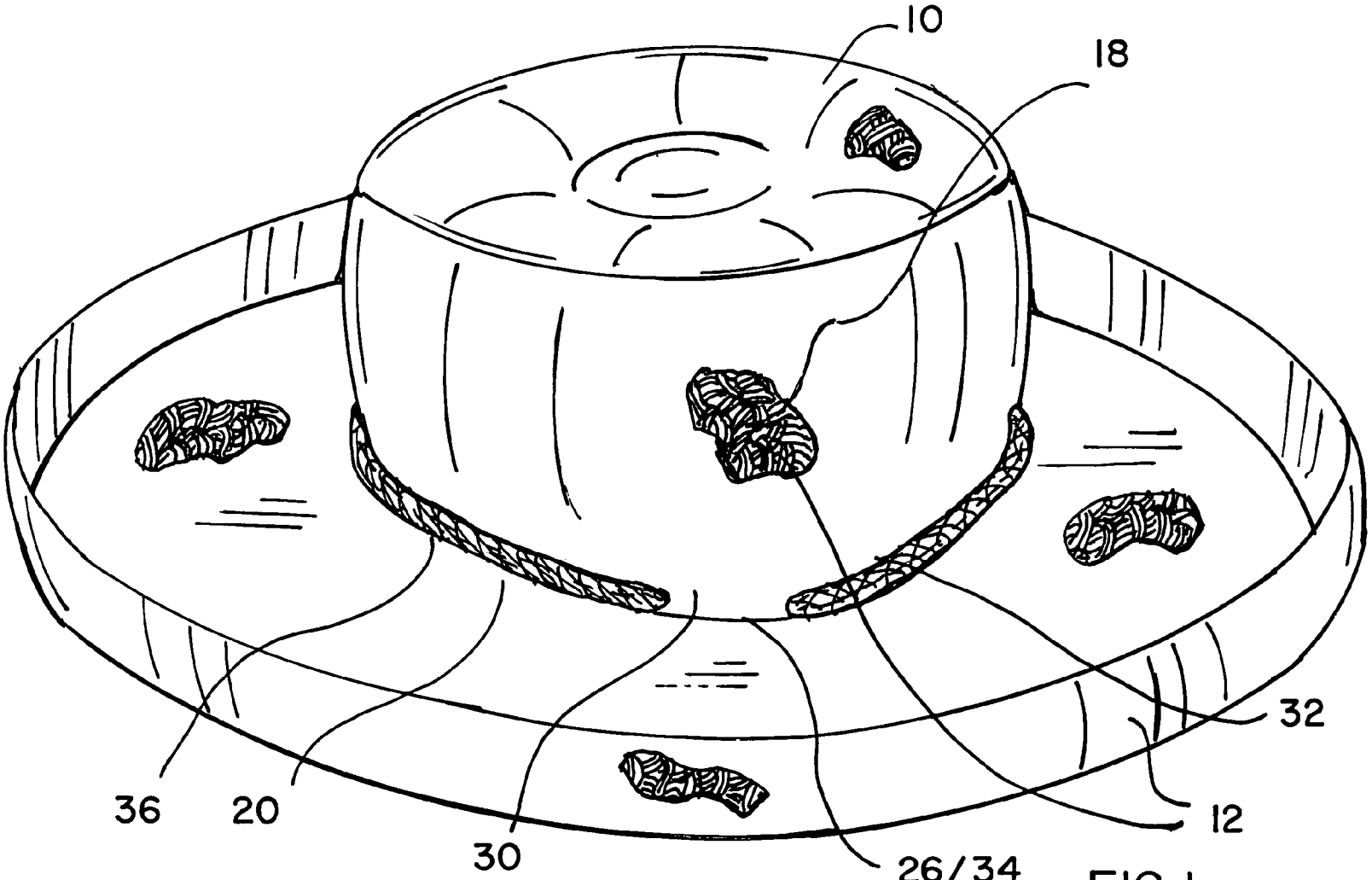
FIG. 1 is a front perspective view of the article.

Said cord 20 includes a beginning 24 (see FIG. 2), a middle (located behind the area of the crochet layer) shown in FIG. 1, and an end 28. Said cord 20 is proportioned for press-fittable insertion between two front openings 30 and 32 in the crochet layer 12 at a front 34 of the crochet layer 12. See FIG. 4A. Said cord 20 is proportioned for press-fittable insertion within said openings 30 and 32 in the crochet layer, said openings typically being about one-inch apart. Said cord 20 may be inserted into said crochet layer 12 using a needle or the like. As such, only about one-inch of the cord is positioned inwardly of the crochet layer, that is, against the head or body of the user. A remaining length of said cord 36 is positioned outwardly of said layer and extends to a back 38 (see FIGS. 1 and 5). Thereat are provided openings 40 and 42 (see FIGS. 3 and 5). Said back openings 40 and 42 are one inch apart, as is the case with said front openings 30 and 32. Each of said front and back openings occupy an imaginary plane in said peripheral surface which the present system provides tightening about.

Figure 2:
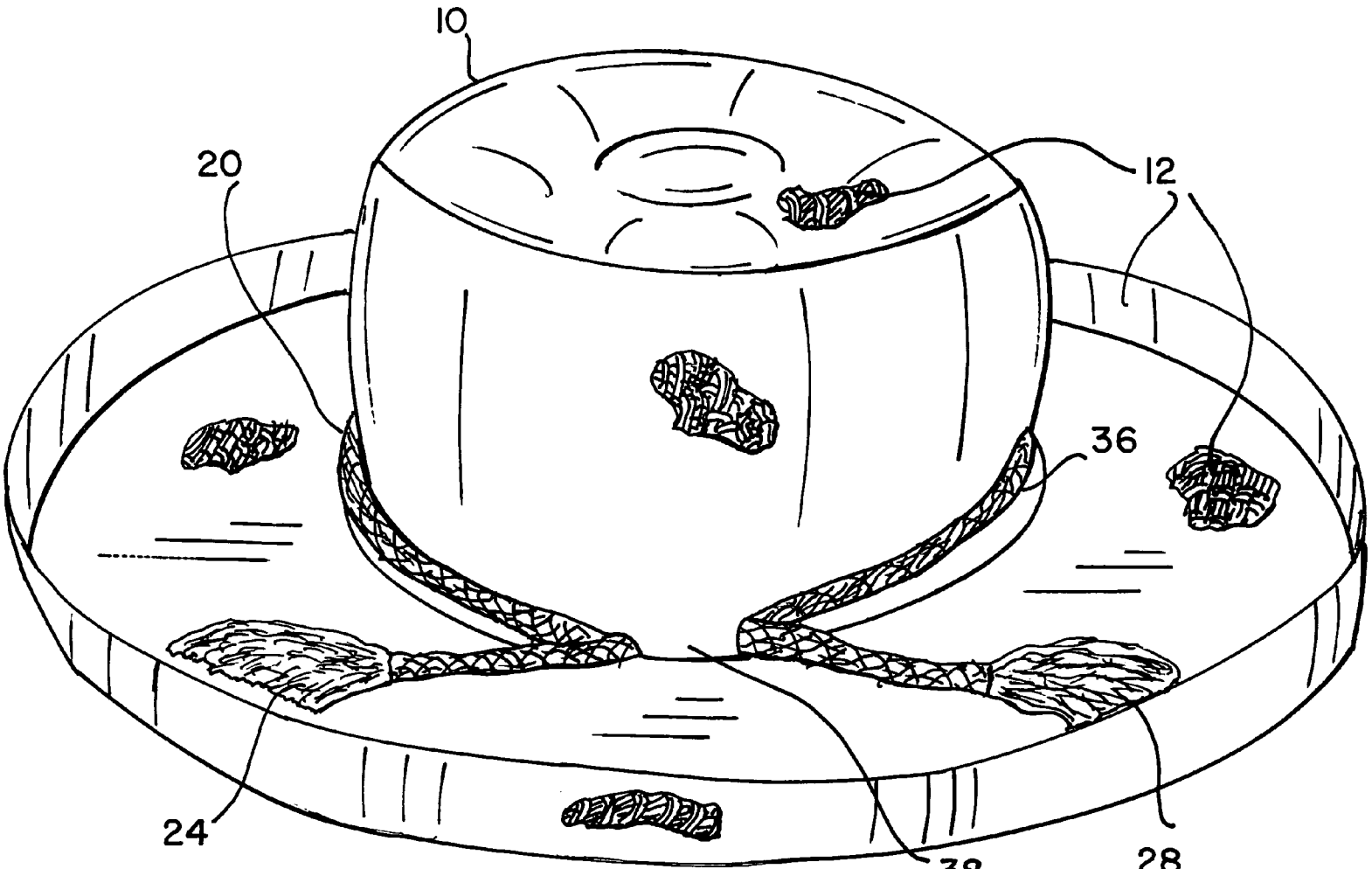
FIG. 2 is a back perspective view of FIG. 1.
Figure 3:
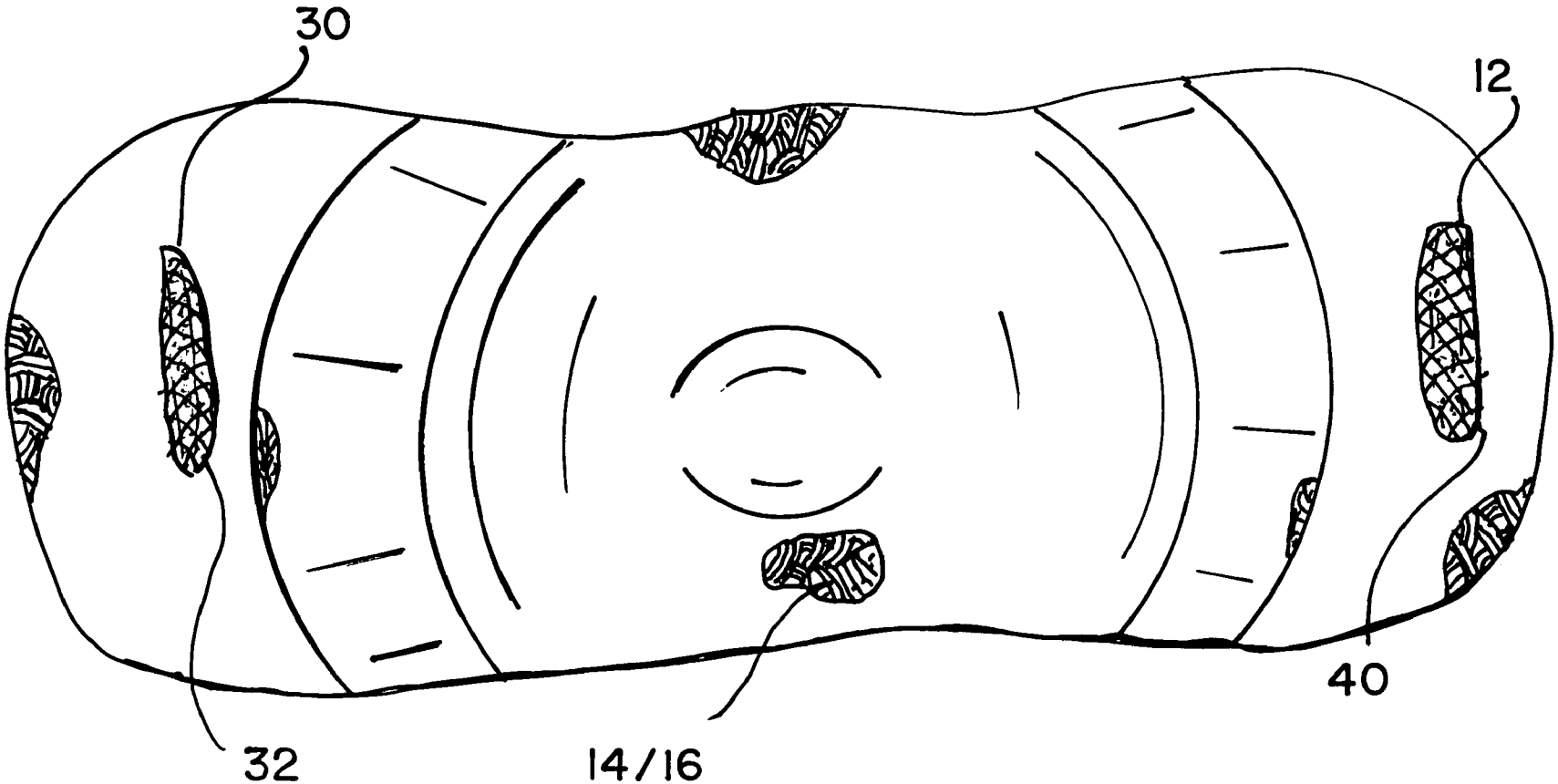
FIG. 3 is a bottom view of FIG. 1.
Figure 5:
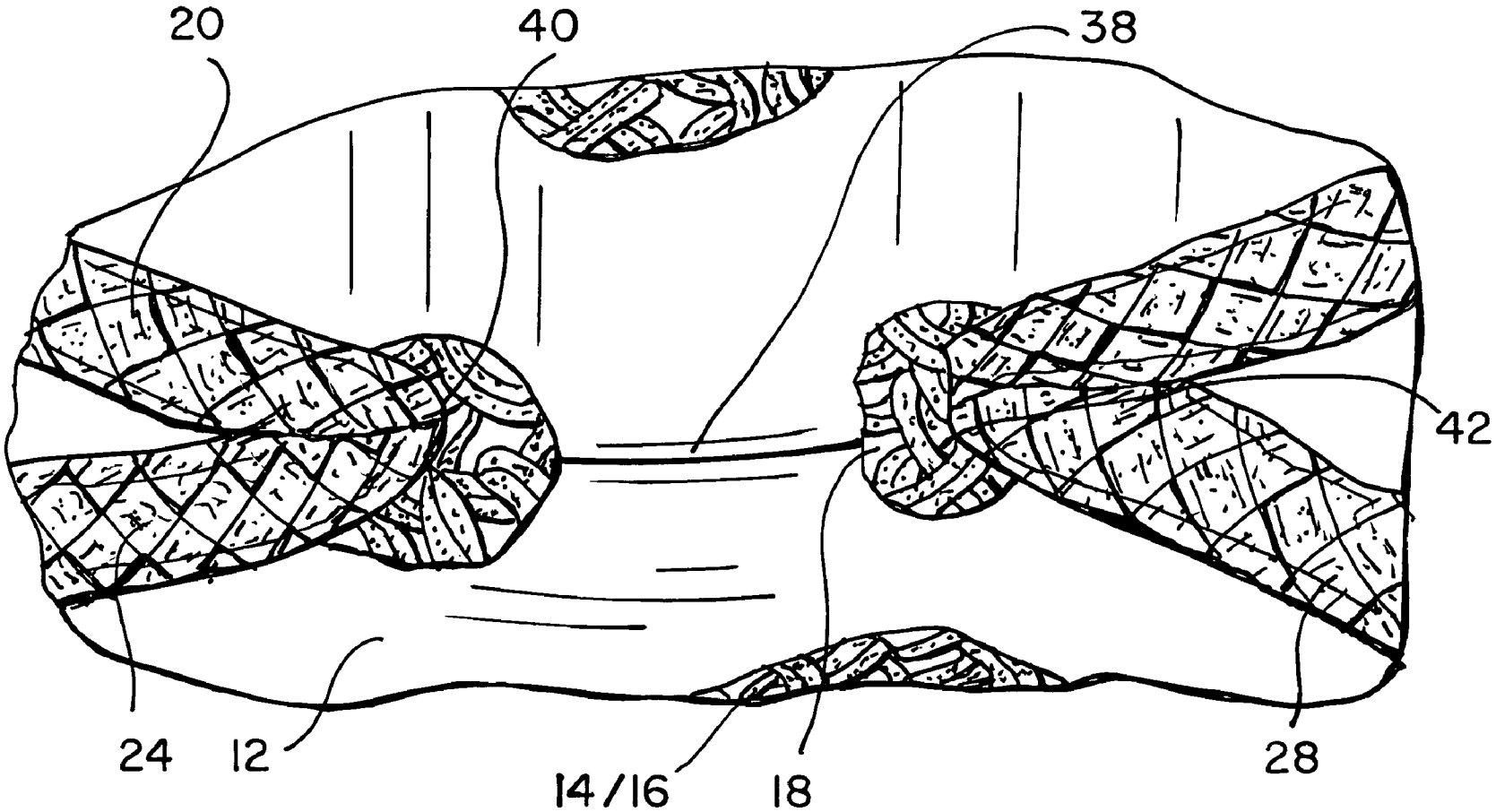
FIG. 5 is a rear view of the openings.
Figure 6:
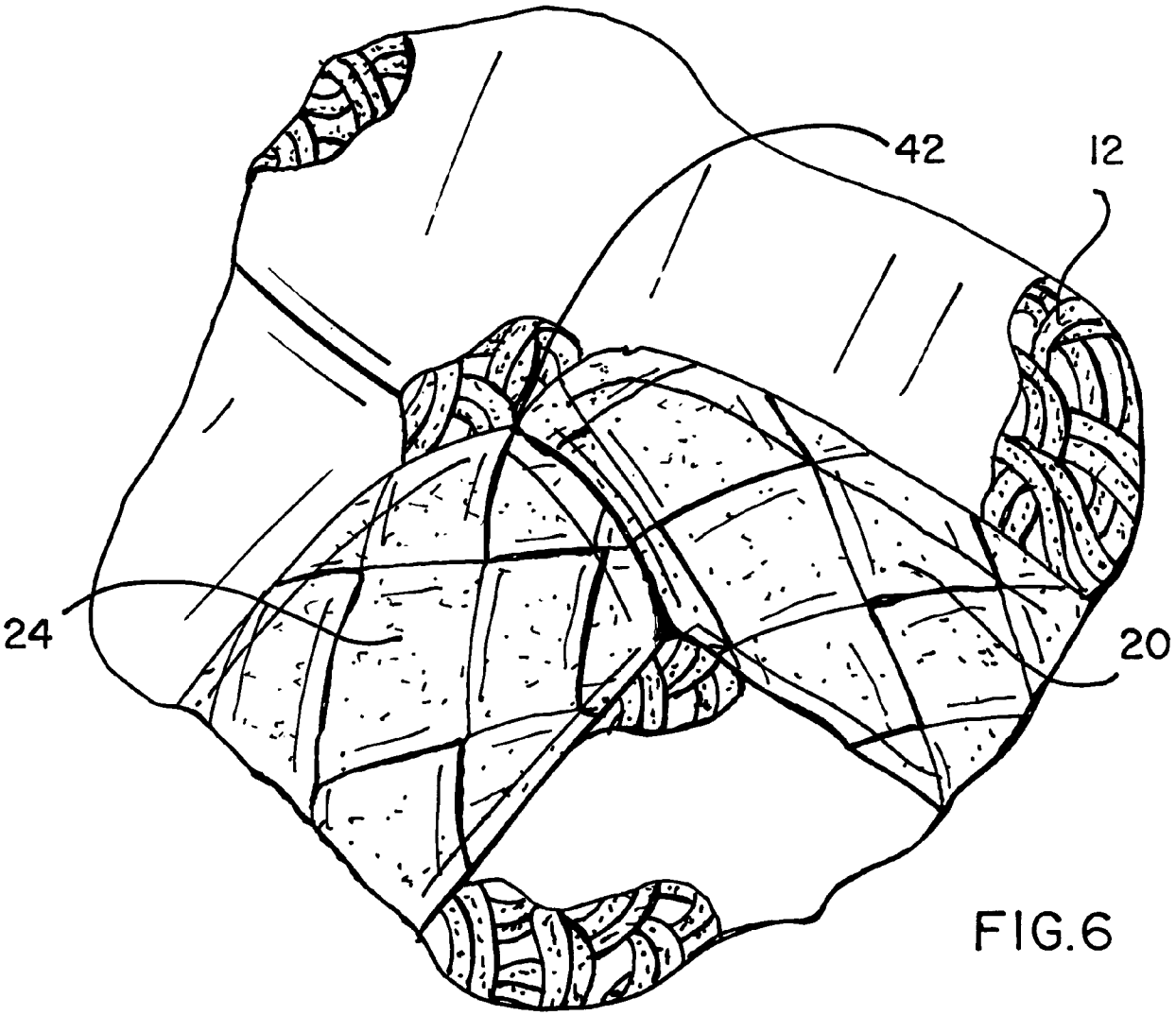
FIG. 6 is an enlarged view of the right rear opening and two cords.

As may be noted in FIGS. 2, 5 and 6, beginning 24 and end 28 of the cord 20 are each press-fittably insertable, however from opposite directions, and upon an outward side of the crochet layer and of said openings, thereby leaving portions of the braided cord at said back openings 40 and 42 in frictional contact with each other and, importantly, with each of said back openings, this as is shown in FIG. 5. As such, segments of both said beginning and end 24 and 28 respectively of the cord 20 extend beyond said back openings (see FIG. 2) and upon the outward side of the crochet layer, thus permitting manual engagement of the beginning and end segments of the cord for purposes of tightening of the hat or article of clothing along said plane of the peripheral surface.

While the preferred embodiment of the present invention entails the use of a sea-grass material for the braiding of said semi-rigid crochet layer and the use of a macramé as the braided filament of the cord or drawstring 20, other material, inclusive of polymeric materials, may be employed as long as the frictional characteristics of the surface of the cord or drawstring relative to the front and back pair of openings is comparable to that of the static friction of sea-grass relative to that of a draw string formed of the macramé fabric. Also, it is desirable that said front and back openings exhibit a diameter in a range of about 3 mm to about 6 mm.

While there has been shown and described the preferred embodiment of the instant invention it is to be appreciated that the invention may be embodied otherwise than is herein specifically shown and described and that, within said embodiment, certain changes may be made in the form without departing from the underlying ideas or principles of this invention as set forth in the Claims appended herewith.

What is claimed is:

1. A system for tightening an article of clothing or accessory having a front and a back and having a peripheral surface crown therebetween necessary to be tightened, the system comprising:

(a) a semi-rigid crochet layer comprising a plurality of braided strands of a fibrous material and defining a pattern in said article having a multiplicity of openings which repeat at a number in a range of about 3 to about 8 per linear inch in all directions, and in which said openings of said layer defines a range of between about 15 to about 35 percent of the entire surface of said crochet layer; and (b) a cord braided of a plurality of filaments of a material more pliable than said braided strands of said crochet layer, said cord having a beginning, a middle and an end, said cord proportioned for press-fittable insertion between two front openings in said crochet layer at said front of said article, said openings about one inch apart, in which only about one inch of said cord is positioned inwardly of said crochet layer, relative to a user, with a remaining length of said cord positioned outwardly of said layer extending until said back of said article, at which each end of said braided cord is press-fittably inserted into and out of back openings, of said crocheted layer, about one inch apart from each other, in which all of said front and back openings occupy a plane in said peripheral surface crown desired to be tightened in which, at said openings, at said back of said article, said beginning and end of said cord are each press-fittably insertable, from opposite directions and on said inward side of said openings of said back two openings, leaving portions of said braided cord at said back openings in frictional contact with each other and also with each of said back openings, in which segments of both said beginning and end of the cord extend beyond said back openings on said outward side of said crochet layer, permitting manual engagement of both segments for purposes of tightening said article of clothing along said plane of said peripheral surface crown.

2. The system as recited in claim 1, in which said semi-rigid crochet layer comprises a sea grass.

3. A system as recited in claim 1, in which said cord comprises a macramé fabric.

4. The system as recited in claim 1, in which said multiplicity of openings in said crochet layer repeat at a number in a range of about 3 to about 5 per linear inch in all directions.

5. The system as recited in claim 1, in which said crochet layer comprises a polymeric material.

* * * * *